United States Patent [19]

Peeler

[11] Patent Number: 4,622,157

[45] Date of Patent: Nov. 11, 1986

[54] HYDRAULIC FLUID SYSTEM WITH PISTON AND VANE PUMPS

[75] Inventor: Robert L. Peeler, Albany, Calif.

[73] Assignee: Chevron Research Company, San Francisco, Calif.

[21] Appl. No.: 782,667

[22] Filed: Sep. 30, 1985

Related U.S. Application Data

[63] Continuation-in-part of Ser. No. 646,398, Aug. 31, 1984, abandoned.

[51] Int. Cl.[4] ..... C10M 137/10; C10M 141/12

[52] U.S. Cl. ..... 252/32.7 E; 252/45; 252/78.5; 252/48.6

[58] Field of Search ..... 252/32.7 E, 45, 78.5, 252/48.6

[56] References Cited

U.S. PATENT DOCUMENTS

| | | | |
|---|---|---|---|
| 4,053,427 | 10/1977 | Hotten | 252/48.6 |
| 4,148,737 | 4/1979 | Liston et al. | 252/32.7 E |
| 4,200,543 | 4/1980 | Liston et al. | 252/32.7 E |

*Primary Examiner*—Jacqueline V. Howard

*Attorney, Agent, or Firm*—S. R. LaPaglia; R. C. Gaffney; J. J. DeYoung

[57] ABSTRACT

In a hydraulic system containing a piston-type and vane-type pump and wherein said piston-type pump contains wear surfaces containing copper or a copper alloy and the vane-type pump contains wear surfaces containing steel, the improvement comprising utilizing a common sump for the hydraulic fluid used in said piston and vane pumps, said hydraulic fluid composition comprising a major amount of an oil of lubricating viscosity and 0.1 to 2.5 weight percent of a zinc dithiophosphate and 0.01 to 5.0 weight percent of a sulfurized ester-olefin containing at least 13 weight percent sulfur.

7 Claims, No Drawings

HYDRAULIC FLUID SYSTEM WITH PISTON AND VANE PUMPS

CROSS REFERENCE TO RELATED APPLICATIONS

This application is a continuation-in-part of Ser. No. 646,398, filed Aug. 31, 1984, now abandoned, the entire disclosure of which is incorporated herein by reference.

BACKGROUND OF THE INVENTION

Hydraulic fluid systems on heavy machinery conventionally comprise vane pumps and/or piston pumps and associated lines, filters, and reservoirs. The pumps provide a high pressure hydraulic fluid to actuators, motors, and/or hydraulic cylinders to provide both motion and positional control of the machinery parts. The high pressure vane pump requires an additive in the hydraulic fluid to provide anti-wear properties and oxidative stability. The preferred additives for vane pumps are the zinc dialkyldithiophosphates. However, these compounds are detrimental to sliding steel-bronze interfaces in the piston pump leading to early, catastrophic failure of the piston pump. Consequently, separate lubricant compositions have been developed for high pressure hydraulic piston pumps and vane pumps. Neither of these separate compositions are satisfactory for both types of pumps. Vane pumps require lubricants containing zinc dithiophosphate extreme pressure additives which however corrode the copper alloy parts of a piston pump. Turbine oils are satisfactory for use in piston pumps but do not provide sufficient chemical reactivity to prevent wear of steel parts in vane pumps. A single hydraulic pump lubricant is desirable, especially for those applications in which both types of pumps draw their lubricant from the same sump.

In the past, various natural and synthetic lubricants compounded with zinc dialkyldithiophosphates have been used as a single hydraulic pump lubricant. These lubricants include mineral oils, paraffinic hydrocarbons, esters of both dibasic and polyol types, and similar materials. However, piston pumps lubricated by these compositions soon fail, due to worn-out bronze load-carrying surfaces.

SUMMARY OF THE INVENTION

In a hydraulic system containing a piston-type and vane-type pump and wherein said piston-type pump contains wear surfaces containing copper or a copper alloy and the vane-type pump contains wear surfaces containing steel, the improvement comprising utilizing a common sump for the hydraulic fluid used in said piston and vane pumps, said hydraulic fluid composition comprising a major amount of an oil of lubricating viscosity and 0.1 to 2.5 weight percent of a zinc dithiophosphate and 0.01 to 5.0 weight percent of a sulfurized ester-olefin containing at least 13 weight percent sulfur.

DETAILED DESCRIPTION OF THE INVENTION

The present invention comprises a hydraulic system containing both piston-type and vane-type pumps and wherein the hydraulic system uses a common sump for the hydraulic fluid. The hydraulic fluid comprises a major amount of an oil of lubricating viscosity and a minor amount of a mixture of zinc dithiophosphates and a sulfurized ester-olefin.

THE PUMPS

Piston-type and vane-type pumps are well known in the art and are available from many different suppliers. Any of these well known piston-type and vane-type pump can be utilized in the present invention provided the piston-type pump contains wear surfaces containing copper or a copper alloy and the vane-type pump contains wear surfaces containing steel. It is with this particularly combination of wear surfaces in the two pumps and utilizing a common sump for the two pumps that the hydraulic fluid described below provides surprising results in preventing wear in the two pumps.

THE HYDRAULIC FLUID

Each of the individual components of the hydraulic fluid are well known in the art.

THE ZINC DITHIOPHOSPHATE

The zinc compound is one of the well-known extreme pressure (EP) additives and include the organic substituted zinc dithiophosphates preferably the zinc dihydrocarbyldithiophosphates, wherein the hydrocarbyl groups contain from 3 to 30 carbon atoms, preferably 5–20 carbon atoms. Mixtures of various zinc compounds can also be used as is well known in the art. The organic substituted zinc dithiophosphates contain an aliphatic group having a functional group such as carboxy, hydroxy, carbalkoxy, and the like. The hydrocarbyl group may be either aliphatic, cycloaliphatic, or aromatic, or mixtures thereof. Most preferred are the zinc dialkyldithiophosphates wherein the alkyl group contains 3 to 30 carbon atoms, preferably 5 to 20 carbon atoms. A preferred zinc compound is zinc di-2-ethylhexyldithiophosphate. The zinc compound is present in a concentration to provide from 100 to 1000 parts per million of phosphorus.

THE SULFURIZED ESTER-OLEFIN

The sulfurized ester-olefins utilized in the present invention are well known in the art and are available commercially. The preferred sulfurized ester-olefin are made in accordance with the disclosure of U.S. Pat. No. 4,053,427, the entire disclosure of which is incorporated herein by reference.

Esters useful in preparing the sulfurized ester-olefin are those having at least 12 carbon atoms in the molecule. Preferably the esters are unsaturated. The esters of this invention are the monoesters of monocarboxylic acid and an alcohol. The acid and alcohol components of the ester contain from 1 to 50 carbon atoms each provided that the total number of carbon atoms in the ester is greater than 11. Esters satisfactory for this purpose may be of natural origin or made synthetically. Typical examples include the animal or vegetable oils such as spermwhale oil, jojoba bean oil, and the like. Synthetic esters are of many types, such as fatty acid esters having at least 12 carbon atoms.

Preferably olefins are added to the sulfurization process and thereby become incorporated in the sulfurized product(cross-sulfurization). For this purpose olefins having at least 10 carbon atoms are preferred. The olefins may be branched but preferably are linear. Linear alpha-olefins obtained by the cracking of wax or the ethylene growth process are preferred.

Sulfurization is accomplished by heating the ester and olefin mixture with pure sulfur or sulfur chlorides at 150–175 degrees centigrade for 2–24 hours to affect sulfur incorporation. The resulting compound mixture has from 13 to 25 weight percent sulfur.

The sulfurized ester-olefins have varying amounts of total sulfur. For the purposes of the present invention, it is necessary to have at least 13 percent, preferably more than 15%, of the total sulfur in the sulfurized ester-olefin.

The sulfurized ester-olefin concentration in the final lubricant composition is sufficient to provide a phosphorus to ester-sulfur atom ratio of 1:1 to 5:1, preferably 2:1 to 4:1. The total sulfur resulting from the sulfurized ester olefin will be in the range of 25–500, preferably 50–200 parts per million sulfur.

The lubricant contains an effective amount of the zinc dithiophosphate and the sulfurized ester-olefin to prevent wear in both piston and vane pumps. Generally the lubricant will contain 0.10 to 2.5 weight percent of the zinc dithiophosphate and 0.01 to 5.0 weight percent of the sulfurized ester-olefin. Preferably the composition contains 0.2 to 1.0 weight percent zinc dithiophosphate and 0.02 to 0.5 weight percent sulfurized ester-olefin.

The lubricating oil to which the zinc dihydrocarbyl dithiophosphate and sulfurized ester-olefin are added can be any hydrocarbon-based lubricating oil or a synthetic base oil stock. The hydrocarbon lubricating oils may be derived from synthetic or natural sources and may be paraffinic, naphthenic or asphaltic base, or mixtures thereof. A variety of other additives can be present in the lubricating oils of the present invention. These additives include antioxidants, viscosity index improvers, dispersants, rust inhibitors, foam inhibitors, corrosion inhibitors, other antiwear agents, and a variety of other well-known additives. Preferred additional additives are the oil-soluble succinimides and oil-soluble alkali or alkaline earth metal sulfonates and phenates.

EXAMPLES

A series of tests were performed on various sample compositions to measure the properties of the lubricant using the Denison piston pump test and the Denison vane pump test. Following the Denison HF0 specifications, a Denison vane pump T5D-042 and a Denison 46 series piston pump were run together on the same test composition. The wear on rubbing surfaces is determined after 100 hours of operation. Scarring or corrosion of the surfaces is a failure. In these examples, the base oil is a midcontinent solvent extracted neutral oil (ISO 46 viscosity grade), containing 2 millimoles/kg. of an overbased calcium alkylphenate and 0.1 percent by weight of a neutral calcium sulfonate.

The test results are shown below in Table I.

TABLE I

COMPARATIVE PUMP TEST RESULTS

| Test Example | Composition | Piston Pump | Vane Pump |
|---|---|---|---|
| 1 | base oil | pass | fail |
| 2 | base oil + Zndpt(1) | fail | pass |
| 3 | base oil + ester(3) | pass | fail |
| 4 | base oil + Zndpt(1) + ester(2) | fail | pass |

TABLE I-continued

COMPARATIVE PUMP TEST RESULTS

| Test Example | Composition | Piston Pump | Vane Pump |
|---|---|---|---|
| 5 | base oil + Zndpt(1) + ester(3) | pass | pass |

(1)0.42 weight percent di-2-ethylyhexyl zinc dithiophosphate (2)0.06 weight percent cross-sulfurized mixture of tall oil ester and cracked wax olefin having 15 to 18 carbon atoms with the product additive containing 10 weight percent sulfur.

(3)0.06 weight percent cross-sulfurized mixture tall oil ester and cracked wax olefin having 15 to 18 carbon atoms with the product additive containing 16 weight percent sulfur.

Example 1 shows that base oil alone is not sufficient to pass both the piston and vane pump test.

Example 2 shows that the addition of zinc dithiophosphate provides good lubrication for a vane pump but is unacceptable for a piston pump.

Example 3 shows that the addition of a sulfurized ester-olefin provides good lubrication for a piston pump but is unacceptable for a vane pump.

Example 4 shows that a lubricant containing both a zinc dithiophosphate and a sulfurized ester-olefin where the sulfur is 10 weight percent provides good lubrication for a vane pump but fails to provide good lubrication for a piston pump.

Example 5 shows that a combination of a zinc dithiophosphate and a sulfurized ester-olefin where the sulfur content is 16 weight percent provides a lubricant satisfactory for both piston and vane pumps.

What is claimed is:

1. In a hydraulic system containing a piston-type and vane-type pump and wherein said piston-type pump contains wear surfaces containing copper or a copper alloy and the vane-type pump contains wear surfaces containing steel, the improvement comprising utilizing a common sump for the hydraulic fluid used in said piston and vane pumps, said hydraulic fluid composition comprising a major amount of an oil of lubricating viscosity and 0.1 to 2.5 weight percent of a zinc dithiophosphate and 0.01 to 5.0 weight percent of a sulfurized ester-olefin containing at least 13 weight percent sulfur and wherein the phosphorus to ester-sulfur atom ratio in said fluid is in the range 1:1 to 5:1 and the total sulfur in said fluid resulting from the sulfurized ester-olefin is in the range of 25–500 parts per million.

2. The hydraulic system of claim 1 wherein said zinc dithiophosphate is a zinc dihydrocarbyldithiophosphate.

3. The hydraulic system of claim 2 wherein said zinc dithiophosphate is a zinc dialkyldithiophosphate.

4. The hydraulic system of claim 3 wherein said sulfurized ester-olefin contains 13–25 weight percent sulfur.

5. The hydraulic system of claim 4 wherein said sulfurized ester-olefin contains more than 15 weight percent sulfur.

6. The hydraulic system of claim 5 wherein said zinc dithiophosphate comprises 0.2 to 1.0 weight percent of said composition and wherein said sulfurized ester-olefin comprises 0.02 to 0.5 weight percent of said composition.

7. The hydraulic system of claim 6 wherein said zinc dithiophosphate is zinc di-2-ethylhexyldithiophosphate and said sulfurized ester-olefin is a cross sulfurized mixture of tall oil ester and a cracked wax olefin containing 15 to 18 carbon atoms.

* * * * *